US009402430B2

(12) United States Patent
Jensen et al.

(10) Patent No.: US 9,402,430 B2
(45) Date of Patent: Aug. 2, 2016

(54) GARMENT FOR CARRYING A BABY TO PROVIDE SKIN-TO-SKIN CONTACT

(71) Applicant: BROWNMED, INC., Spirit Lake, IA (US)

(72) Inventors: Daniela Jensen, Barrington, RI (US); Hope Parish, Barrington, RI (US)

(73) Assignee: Brownmed, Inc., Spirit Lake, IA (US)

( * ) Notice: Subject to any disclaimer, the term of this patent is extended or adjusted under 35 U.S.C. 154(b) by 0 days.

(21) Appl. No.: 13/828,177

(22) Filed: Mar. 14, 2013

(65) Prior Publication Data

US 2013/0291279 A1 Nov. 7, 2013

Related U.S. Application Data

(60) Provisional application No. 61/642,698, filed on May 4, 2012.

(51) Int. Cl.

| | |
|---|---|
| ***A41D 27/20*** | (2006.01) |
| ***A41D 1/22*** | (2006.01) |
| ***A41D 1/20*** | (2006.01) |

(52) U.S. Cl.

CPC ..... *A41D 27/20* (2013.01); *A41D 1/205* (2013.01); *A41D 1/22* (2013.01); *A41D 2400/482* (2013.01)

(58) Field of Classification Search

CPC ..... A41D 2400/48; A41D 2400/482; A41D 2600/10

USPC ..... 2/237, 238, 94, 48, 106, 247, 249, 250

See application file for complete search history.

(56) References Cited

U.S. PATENT DOCUMENTS

| | | | | | |
|---|---|---|---|---|---|
| 416,970 | A | * | 12/1889 | Taylor | 224/159 |
| 484,065 | A | * | 10/1892 | Taylor | 224/160 |
| 2,010,903 | A | * | 8/1935 | Swanson | 2/69 |
| 2,260,168 | A | * | 10/1941 | Costanza | 2/76 |
| 2,707,282 | A | * | 5/1955 | Paterson | 2/114 |
| 3,426,363 | A | * | 2/1969 | Girard | 2/338 |
| 3,481,517 | A | * | 12/1969 | Aukerman | 224/160 |

(Continued)

FOREIGN PATENT DOCUMENTS

| | | |
|---|---|---|
| BE | 888536 | 8/1981 |
| WO | 2005025347 | 3/2005 |
| WO | 2009081400 | 3/2010 |

OTHER PUBLICATIONS

International Search Report and Written Opinion for Application No. PCT/US2013/039461, issued Sep. 12, 2013.

(Continued)

*Primary Examiner* — Katherine Moran

(74) *Attorney, Agent, or Firm* — McKee, Voorhees & Sease, PLC

(57) ABSTRACT

Garments and methods are provided for carrying an infant in skin-to-skin contact. In one exemplary embodiment, a garment can have a back panel and two front panels. The front panels can be configured to overlap and adjustably couple together such that the front panels can securely hold a baby against a wearer's chest. One of the front panels can have a pocket formed on an interior surface thereof that is configured to prevent a baby from slipping out of the garment. The garment can also have an adjustable belt configured to be positioned around the garment. The belt can provide additional support to the garment for securely holding a baby against a wearer's chest.

19 Claims, 3 Drawing Sheets

(56) References Cited

U.S. PATENT DOCUMENTS

| | | | | | |
|---|---|---|---|---|---|
| 3,555,569 | A * | 1/1971 | Jones | 2/221 |
| 4,079,467 | A * | 3/1978 | Baldwin | 2/94 |
| 4,579,264 | A * | 4/1986 | Napolitano | 224/160 |
| 4,698,848 | A * | 10/1987 | Buckley | 2/114 |
| 4,724,987 | A * | 2/1988 | Maheu | 224/159 |
| 5,097,536 | A * | 3/1992 | Cohen | 2/114 |
| 5,267,352 | A * | 12/1993 | Rodarmel | 2/44 |
| 5,454,376 | A * | 10/1995 | Stephens et al. | 600/534 |
| 5,586,969 | A * | 12/1996 | Yewer, Jr. | 602/19 |
| 5,611,086 | A * | 3/1997 | Eggen | 2/104 |
| D390,961 | S * | 2/1998 | Walker et al. | D24/190 |
| 5,946,725 | A * | 9/1999 | Shatzkin et al. | 2/106 |
| 6,327,712 | B1 * | 12/2001 | Armstrong et al. | 2/104 |
| 6,397,392 | B1 * | 6/2002 | Wooley | A41D 15/04 2/102 |
| 6,536,047 | B1 * | 3/2003 | Mullaly | 2/48 |
| 6,715,155 | B2 * | 4/2004 | Duflos | 2/237 |
| D539,509 | S * | 4/2007 | Fugazzi | D2/830 |
| D556,330 | S * | 11/2007 | Auerbach et al. | D24/190 |
| 7,296,303 | B1 * | 11/2007 | Samet | 2/115 |
| 7,437,774 | B2 * | 10/2008 | Baron et al. | 2/69 |
| 7,913,321 | B2 * | 3/2011 | Radcliffe et al. | 2/69 |
| 7,926,448 | B2 * | 4/2011 | Fox | 119/497 |
| 8,302,214 | B2 * | 11/2012 | McGrath | 2/114 |
| 8,484,763 | B1 * | 7/2013 | Lucas | 2/89 |
| 8,719,966 | B2 * | 5/2014 | Grozdev | 2/247 |
| 2004/0226073 | A1 * | 11/2004 | McCullar et al. | 2/114 |
| 2006/0005294 | A1 * | 1/2006 | Fugazzi | 2/115 |
| 2006/0206978 | A1 | 9/2006 | Hilton et al. | |
| 2008/0000006 | A1 * | 1/2008 | Ochoa et al. | 2/114 |
| 2008/0149674 | A1 | 6/2008 | Hiniduma-Lokuge | |
| 2009/0159628 | A1 * | 6/2009 | McMullen | 224/576 |
| 2009/0199781 | A1 * | 8/2009 | Fox | 119/497 |
| 2011/0108594 | A1 * | 5/2011 | Davis | 224/623 |
| 2012/0234877 | A1 * | 9/2012 | Hiniduma-Lokuge | 224/159 |

OTHER PUBLICATIONS

No author listed. Kan-go Wrap with ¾ Sleeves—Patent Pending (7009). With Instruction Sheet. Precious Image™ creations. http://www.preciousimagecreations.com/Scripts/prodView.asp?idproduct=96. Last accessed May 2, 2012. 4 pages.

European Patent Office, "Examination Report", issued in connection to International Application No. 13784312.4, mailed Apr. 1, 2016, 3 pages.

* cited by examiner

GARMENT FOR CARRYING A BABY TO PROVIDE SKIN-TO-SKIN CONTACT

CROSS REFERENCE TO RELATED APPLICATIONS

The present application claims the priority of U.S. Provisional Application Ser. No. 61/642,698 filed May 4, 2012, entitled "Garments and Methods for Carrying a Baby to Provide Skin-to-Skin Contact," which is hereby incorporated by reference in its entirety.

FIELD OF THE INVENTION

The present invention relates generally to garments and methods for carrying a baby to provide skin-to-skin contact.

BACKGROUND OF THE INVENTION

There is a growing body of evidence that proves that skin-to-skin contact, also known as "kangaroo care," practiced immediately after birth and beyond, offers multiple medical benefits for both mom and baby. Kangaroo care is a holding technique where the care provider positions baby, who is wearing only a diaper, vertically against their bare chest. The infant's shoulders should be flat against the mother's chest, on or above her breasts, so constriction of the chest does not occur, impeding repertory expansion. The infant's nose should be unobstructed, with their head turned to one side, resting under mom's collarbone. Full chest to chest contact between the provider and baby is crucial as this is the location of the C-Afferent nerve, that when stimulated causes a hormonal cascade to occur, resulting in all of the physiological benefits that kangaroo care offers. The nerve is particularly sensitive at this specific location over the front (ventral) chest and sends a message of pleasure to a deep part of the brain where oxytocin is produced. Oxytocin is a hormone that creates a sense of calm, happiness and contentment. The presence of oxytocin reduces the stress response hormone from being released and prohibits an increase in heart rate, breathing rates, blood pressure, and growth/recovery delays for baby. Simply stated, skin-to-skin contact eliminates stress responses in baby's brain and body. It is suggested that infants remain in kangaroo care for an uninterrupted sixty minutes for the baby to receive the following benefits: accelerated brain development, synchronization of heart rate and breathing, regulation of body temperature, improved quality of sleep, increased immunity, aids in digestion, improves to weight gain, cries less and remains calm.

As it relates to breastfeeding, there is a dose to dose response between kangaroo care and milk production. The longer time an infant spends in skin-to-skin contact, the more milk mom produces. Hospitals are initiating non-separation and birth kangaroo care to advocate for breastfeeding. Inadequate milk supply is the number one cause for mothers to supplement or discontinue breastfeeding. Infants held in kangaroo care the first hour after birth are twice as likely to breastfeed than a swaddled infant.

Accordingly, there remains a need for improved methods and devices for holding a baby in proper skin-to-skin contact position.

BRIEF DESCRIPTION OF THE DRAWINGS

The invention will be more fully understood from the following detailed description taken in conjunction with the accompanying drawings, in which.

DETAILED DESCRIPTION OF THE INVENTION

Figure 1:
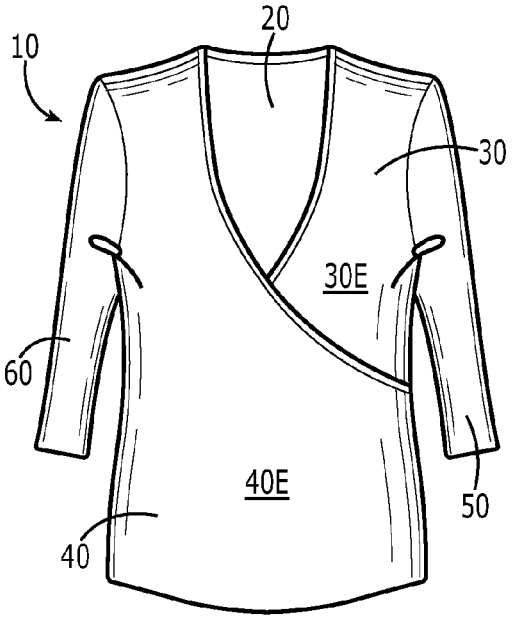
FIG. 1 is a front view of one embodiment of a garment.

Certain exemplary embodiments will now be described to provide an overall understanding of the principles of the structure, function, manufacture, and use of the devices and methods disclosed herein. One or more examples of these embodiments are illustrated in the accompanying drawings. Those of ordinary skill in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention.

Various exemplary garments and methods are provided for carrying an infant in a manner that provides skin-to-skin. In general, the methods and devices allow an infant to be securely held against an adult's chest to maximize benefits of skin-to-skin contact, while allowing the adult's hands to be free.

FIGS. 1-4 illustrate one exemplary embodiment of an adult garment 10 for carrying a baby in a way that the baby can have beneficial skin-to-skin contact with an adult wearer of the garment. The garment 10 is in the form of a blouse or shirt, and can have a back panel 20 and two front panels 30, 40 attached to opposite sides of the back panel 20. The front panels are designed to hold an infant in skin-to-skin, kangaroo care position against the wearer's chest. The garment can have arm openings formed between the back panel 20 and each of the front panels 30, 40, and the garment can optionally include sleeves 50, 60 coupled to the front and back panels and extending from the arm openings. This panel design allows for quick, easy access for placing and removing any size infant against a wearer's chest. The sizes and shapes of each panel can vary such that the garment can be available in multiple sizes and styles.

The back panel 20 can have various configurations, but in an exemplary embodiment the back panel is configured to cover a wearer's back, extending between left and right sides of the wearer. In the illustrated embodiment, the back panel 20 has a generally rectangular shape with a top edge or side 20*t*, a bottom edge or side 20*b*, and left and right sides 20*l*, 20*r* that extends between the top and bottom sides 20*t*, 20*b*. The top side 20*t* can extend laterally across the wearer between left and right sides of the wearer's body. The top side 20*t* can be positioned along a wearer's shoulders and across the back of a wearer's neck. The bottom side 20*b* can likewise extend laterally across a wearer's body, and can be located anywhere along the wearer back side. The left and right sides 20*l*, 20*r* can extend along the left and right sides of the wearer's body, respectively, to connect to the front panels, as discussed in detail below. The back panel can have a width $W_B$ and a length $L_B$ that can vary. In an exemplary embodiment, the width $W_B$ is in the range of about 15 inches to 30 inches, and preferably 15 inches to 25 inches, and more preferably 16 inches to 23 inches. A person skilled in the art will appreciate that the back panel 20 can have a variety of configurations, and can include various design features known in the art. By way of example, in another embodiment the back panel can include a yoke panel that runs horizontally across the top of the wearer's shoulders to reinforce weight support for the front panels.

Figure 2:
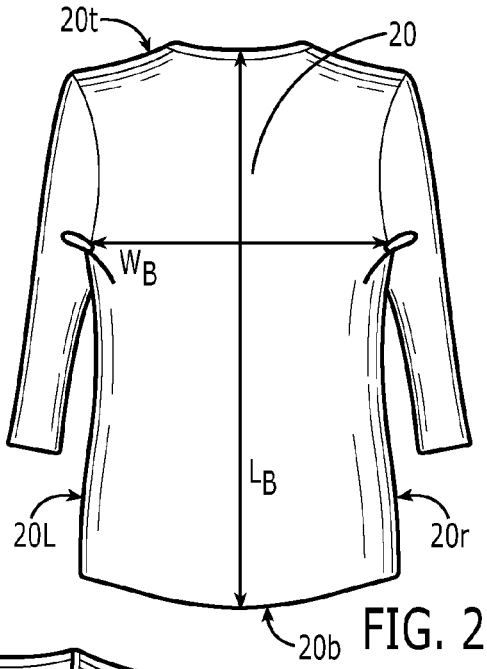
FIG. 2 is a back view of the garment of FIG. 1.
Figure 3:
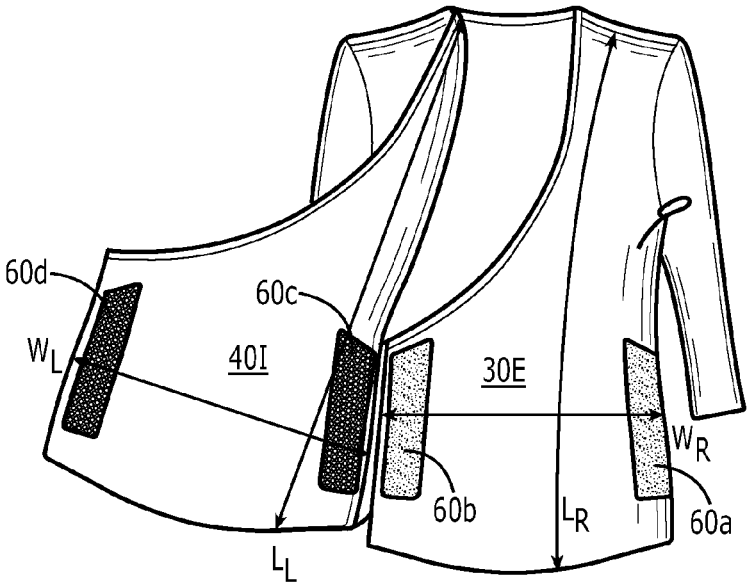
FIG. 3 is a front view of the garment of FIG. 1 with a first front panel opened.

Each of the front panels 30, 40 can be mated to one of the left and right sides of the back panel 20. As shown in FIGS. 1-3, the first front panel 30 is mated to the left side 20*l* of the back panel 20, and the second front panel 40 is mated to the right side 20*r* of the back panel 20. The front and back panels 20, 30, 40 can be mated using various techniques known in the art, such as by stitching the panels together along the edges to form a seam.

Figure 4:
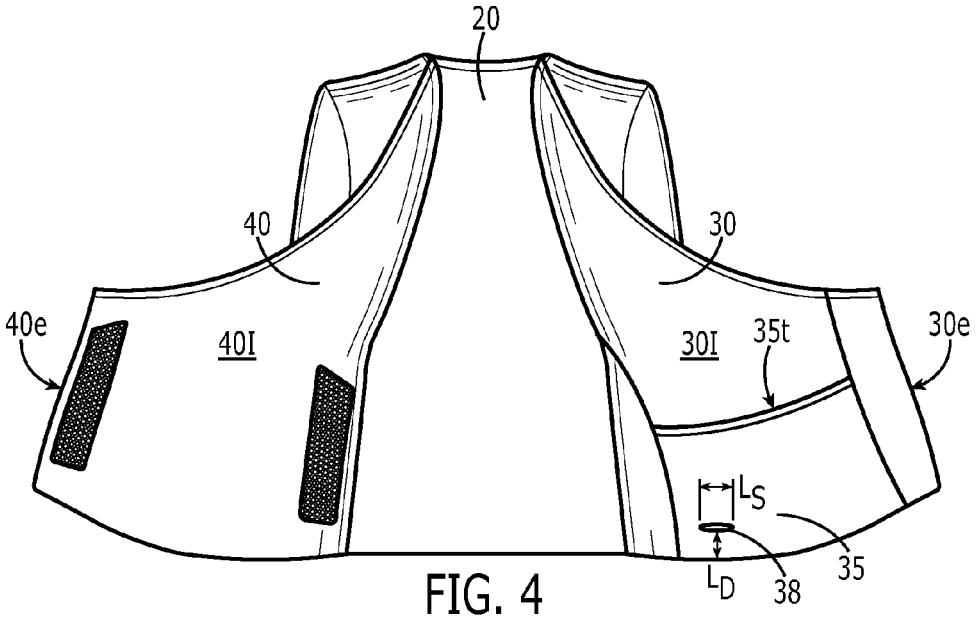
FIG. 4 is a front view of the garment of FIG. 3 with a second front panel opened.

Each front panel 30, 40 can have an interior surface 30I, 40I configured to face inward towards the wearer's body, and an exterior surface 30E, 40E configured to face away from the wearer's body, as illustrated in FIGS. 1, 3, and 4. The front panels 30, 40 can have a configuration that allows the panels to overlap or cross over each other such that together they can provide coverage of a desired portion of a wearer's and a baby's body, as well as provide support to the mom and infant. While the particular shape of each front panel can vary, in one embodiment, as shown, the front panels can be configured such that the panels can overlap to create a V-shaped front neckline for the garment. Alternatively, the front panels can be formed such that other types of necklines are created, for example, a square neck, a round neck, a scoop neck or a boat neck. While the garment can have various necklines, the neckline can allow adequate coverage to provide support for a baby, securely holding it against a wearer's chest and front side. The neckline can also allow adequate space and air for a baby's comfort and breathing. The front panels 30, 40 can also be reinforced such that, depending on which way a baby is facing, one of the front panels 30, 40 can be tucked around the back of the baby's head or positioned around the head, similar to a hood, to provide head and neck support and to keep the baby's face and airways un-occluded. The front panels 30, 40 can have a width $W_R$, $W_L$ and a length $L_R$, $L_L$ that can vary. The width $W_R$, $W_L$ can be measured from where the front panel 30, 40 meets the left or right side 20*l*, 20*r* of the back panel 20 to a free end 30*e*, 40*e* of the front panel 30, 40. In an exemplary embodiment, the width of each front panel is in the range of about 13 inches to 30 inches, and preferably 15 inches to 25 inches, and more preferably 16 inches to 24 inches, and the length of each front panel is in the range of about 25 inches to 40 inches, and preferably 25 inches to 35 inches, and more preferably 27 inches to 30 inches. The dimensions of the front panels can be independent of each other, but preferably the length of both front panels is substantially equal.

In order to facilitate secure holding of the baby against the wearer's chest, the front panels can mate to one another using various techniques. For example, one of the front panels can have one or more fasteners that mates to one or more corresponding fasteners on the other front panel. By way of non-limiting example, FIG. 3 illustrates first and second fasteners 60*a*, 60*b* formed on or attached to the exterior surface 30E of the first front panel 30, and third and fourth fasteners 60*c*, 60*d* formed on or attached to the interior surface 40I of the second front panel 40. While the fasteners can be positioned at various locations, in this embodiment the first fastener 60*a* is positioned adjacent to the left side 20*l* of the back panel 20, and the second fastener 60*b* is positioned on an opposite side of the front panel 30, adjacent to a terminal edge. The third fastener 60*c* on the second front panel 40 is positioned adjacent to the right side 20*r* of the back panel 20, and the fourth fastener 60*d* is positioned on an opposite side of the front panel 40, adjacent to a terminal edge. As a result, the front panels 30, 40 can be coupled together by positioning the fasteners in mating engagement with one another. In particular, the first front panel 30 can be positioned against a wearer's front side, and the second front panel 40 can be pulled across and over the first front panel 30 to mate the third fastener 60*c* with the second fastener 60*b* and to mate the fourth fastener 60*d* with the first fastener 60*a*. Optionally, in some embodiments, one or both of the front panels can couple to an interior or exterior surface of the back panel. The coupling of the front panels to each other can provide a secure compression fit for a baby resting vertically against a wearer's chest. The fasteners can be configured such that a size of the garment can be adjusted by coupling the fasteners on the second front panel 40 at various locations relative to the fasteners on the first front panel. While not shown, the fasteners can optionally have a size that allows the fasteners to mate at multiple positions. As a result, the garment can allow for custom sizing as the wearer's and the baby's bodies change. Though the illustrated embodiment shows hook and loop fasteners, specifically Velcro®, various fasteners can be used, such as other hook and loop fasteners, buttons, snaps, zippers, belts, ties, magnets, and adhesives, by way of non-limiting example. Preferably, the fasteners can allow for one-handed fastening, allowing a wearer to support a baby with one hand while securing the garment around them with the other hand. In some embodiments, instead of having fasteners, the front panels can have a length sufficient to allow the panels to wrap around a wearer's body and be knotted or tied to secure a compression fit.

The first front panel 30 can also include a pocket 35 formed on an interior surface 30I thereof to prevent a baby from slipping out the bottom of the garment 10, as shown in FIG. 4. The pocket 35 can be formed by folding an extended portion of the front panel 30 inside the garment 10 and securing lateral edges of the extended portion to the interior surface 30I of the front panel 30. The top edge 35*t* of the pocket 35 can be unattached from the front panel 30 such that a baby's legs can be tucked inside the pocket 35 while secured in the garment 10. Alternatively, the pocket 35 can be formed by attaching a separate piece of material to the interior surface 30I of the front panel 30. The pocket 35 can also optionally be reinforced such that it can support a baby's weight. The pocket can be formed along an entire bottom portion of the interior surface 30I of the front panel 30, or alternatively, the pocket can be formed along a portion of the interior surface 30I. A person skilled in the art will appreciate that a variety of techniques can be used to form a pocket, and that the pocket can have various shapes and sizes and can be positioned at various locations inside the first front panel 30. In an exemplary embodiment, the pocket is positioned to function as a safety feature, only to support the baby should the baby slip down the wearer's chest. Otherwise, the pocket can be provided but will not support the baby when the baby is properly positioned on the wearer's chest. In one embodiment, the pocket 35 can have one or more slits formed therein configured to provide access to a baby within the pocket while maintaining skin-to-skin contact. While the one or more slits can be positioned at various locations on the pocket, FIG. 4 illustrates a slit 38 positioned adjacent to the bottom of pocket 35 and while a distance D of the slit from the bottom edge can vary, in an exemplary embodiment the distance is in the range of about 2 inches to 6 inches, and preferably 3 inches to 5 inches. The length L of the slit can also vary, but preferably the length is sufficient to allow access by an instrument, allow the baby's foot to pass therethrough, or even to allow an adult hand to be passed therethrough. In an exemplary embodiment, the length is in the range of about 2 inches to 5 inches, and preferably 3 inches to 4 inches. The slit can be configured to provide access to the baby's foot, for example, to draw blood or to measure temperature.

The garment can have various configurations or styles. As mentioned above, the garment 10 can have armholes (not shown) that can lead to optional sleeves. FIGS. 1-4 illustrate long sleeves 50, 60, however, it will be understood that the garment can have short sleeves, three-quarter sleeves, or the garment can be sleeveless. The garment can come in multiple pre-determined sizes, e.g., XS, S, M, L, XL and 2XL.

The garment can be formed from various materials. The garment can be entirely formed of the same material, or alternatively, various portions of the garment can be formed from different materials. For example, as discussed above, the front panel(s) and/or the pocket can be reinforced, and thus can be formed from a sturdier material than the rest of the garment. By way of non-limiting example, the material can be soft, breathable, moisture-wicking, anti-bacterial, natural, synthetic, odor-resistant, and machine washable. In an exemplary embodiment, the material is also elastic.

Figure 5:
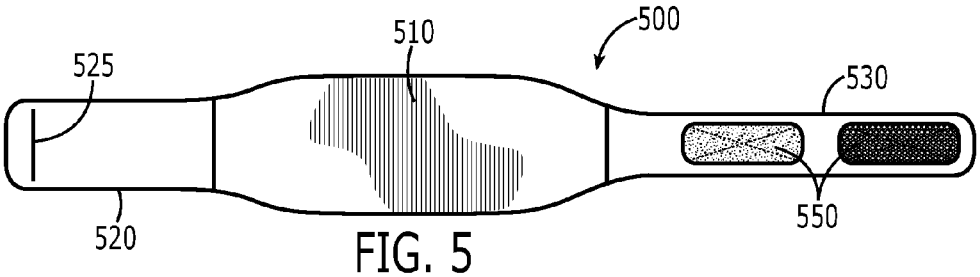
FIG. 5 is a front view of one embodiment of a belt.
Figure 6:
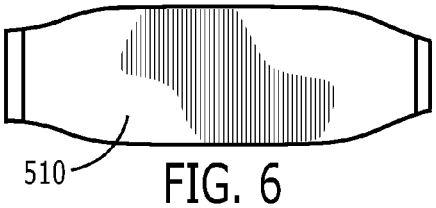
FIG. 6 is a front perspective view of the belt of FIG. 5 as worn.

As discussed above, the garment can also have a detachable belt that can be positioned around the garment. As illustrated in FIG. 5, the belt 500 can have an elongate configuration with a central support portion 510 and two straps 520, 530 extending from opposed ends thereof. The straps 520, 530 can be configured to couple together such that the belt 500 can be secured around the garment 10 and around the wearer's waist. The belt 510, including the central support portion 510 and the two straps 520, 530, can have an interior surface that is configured to be worn facing a wearer's body and an exterior surface configured to be worn facing away from a wearer's body.

The central support portion can be configured to be worn adjacent to the front panels of the garment such that the central support portion can provide additional support to the garment for supporting a baby resting on a wearer's chest. For example, the central support portion can be positioned around a baby's bottom to function as a seat to allow the baby to be retained on the wearer's chest without requiring the wearer to hold the baby, i.e., hands-free. The central support portion 510 can have a width greater than or equal to a width of the straps 520, 530 such that the width of the central support portion 510 can support a baby, such as by supporting a baby in a seated or semi-seated position, for example. In some embodiments, the central support portion 510 can be configured to be placed under a baby's rear end. The central support portion can be reinforced such that it can support a heavier weight. The central support portion can have various shapes, but preferably, the central support portion has an elongate rectangular shape with a size that is comfortable for the wearer.

Figure 7:
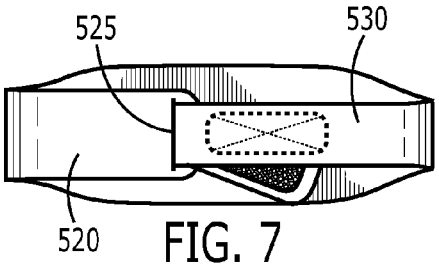
FIG. 7 is a back perspective view of the belt of FIG. 6 as worn.

As discussed above, the belt 500 can have straps 520, 530 that extend from opposed ends of the central support portion 510 and that are configured to wrap around a wearer and adjustably couple together such that the belt provides additional support to the garment. The straps can couple together in various ways, such as by being tied together, buckled, using fasteners, such as hook and loop fasteners, etc. The shape and length of the straps can vary based on the manner in which the coupling occurs. For example, in embodiments where the straps are tied together, the straps can have a length sufficient to wrap around a wearer's body and be securely tied together. FIG. 5 illustrates hook and loop fasteners, such as Velcro®, formed on an interior surface of the second strap 530. Though the fasteners in this embodiment are situated only on an interior surface of the second strap, in other embodiments the fasteners can be located on the exterior surface, on both the interior and exterior surfaces, or on the first strap, as well. As illustrated in FIGS. 5 and 7, a first strap of the belt 520 can have a vertical slit 525 formed therethrough such that a second strap 530 can be threaded through the slit 525. Alternatively, instead of a vertical slit, a D-ring can be located on the first strap through which the second strap can be threaded. The portion of the strap that contains the vertical slit or the D-ring can be reinforced such that damage from repeated threading and pulling of the first strap is minimized. While FIG. 7 shows the second strap 530 being threaded through the vertical slit 525 from the exterior surface of the first strap 520 towards the interior surface, it will be understood that alternatively the second strap can be threaded from the interior surface towards the exterior surface of the first strap. After the second strap is threaded through the vertical slit, the second strap can be pulled to adjust a size of the belt. The second strap can be folded over on itself such that the fasteners on the second strap couple together and fix the belt at a desired size. In some embodiments, the garment 10 can have loops (not shown) through which the belt 500 can be threaded. In some embodiments, the belt 500 can be worn with various garments. The belt 500 can be formed from the same materials as the garment 10 or different materials.

Figure 8A:
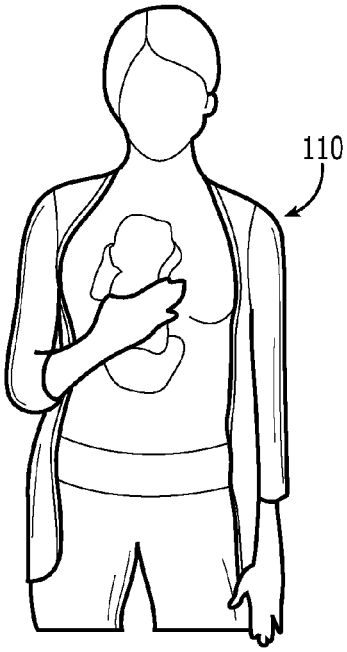
FIG. 8A shows a person wearing the garment of FIG. 1 while holding a baby against the wearer's chest with a first hand.
Figure 8B:
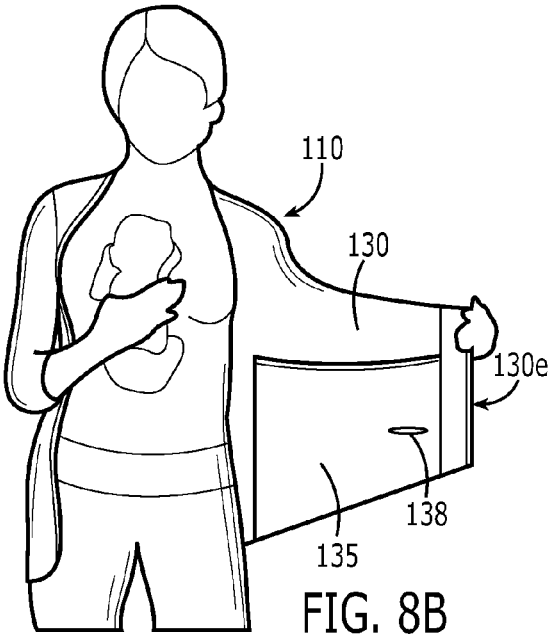
FIG. 8B shows the wearer of FIG. 8B holding a free end of a front panel with a second hand.
Figure 8C:
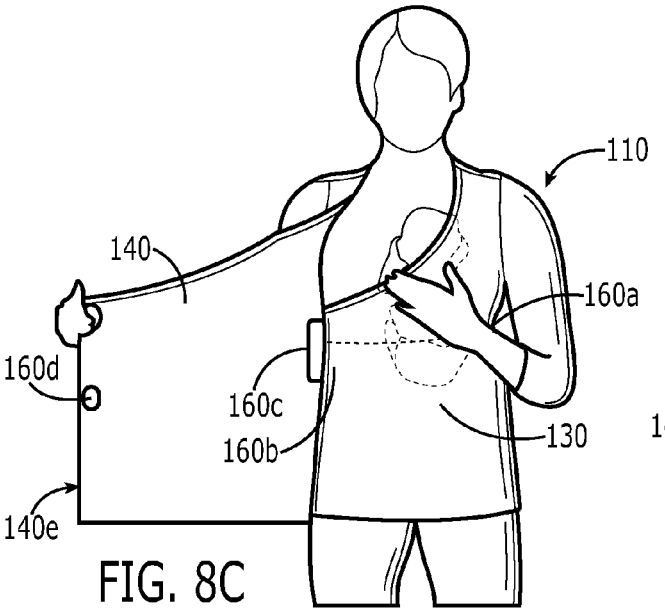
FIG. 8C shows the first panel of FIG. 8B drawn across the baby's back with the free end fastened to the garment.
Figure 8D:
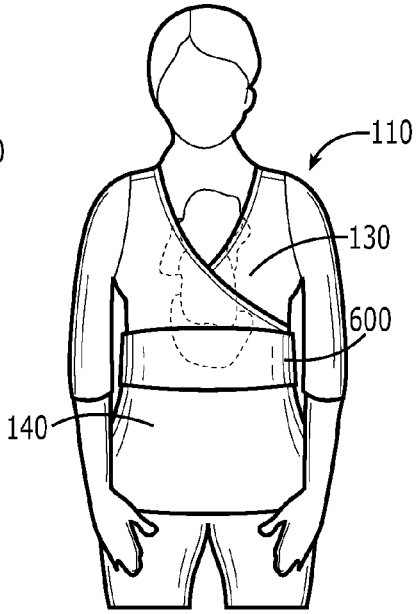
FIG. 8D shows the baby secured within the garment and supported by a belt.

The garments described above can be used to carry an infant against a wearer's chest allowing hands-free skin-to-skin kangaroo care. FIGS. 8A-8D illustrate an exemplary method of using the garments shown in FIGS. 1-7. A wearer can initially put his or her arms through the armholes such that a back panel of the garment is adjacent to and can rest on the wearer's back. A baby can be held directly against the wearer's chest such that the baby is facing the wearer, as shown in FIG. 8A. A first front panel 130 can be drawn across the baby's back and fastened to the garment 110, as illustrated by FIGS. 8B and 8C. While FIGS. 8B and 8C show a free end 130*e* of the front panel 130 can be fastened to the garment 110 by hook and loop fasteners 160*a-d*, various other fasteners can be used as described above. The baby's feet can be guided into an internal pocket 135 on the first front panel 130 to provide security against the baby slipping out from the bottom of the garment 110. A portion of the baby within the internal pocket 135, such as the baby's feet, for example, can be accessed via slit 138 while maintaining skin-to-skin contact. Drawing blood or taking the baby's temperature via the slit while maintaining skin-to-skin contact can allow convenience, by increasing stability and reducing the need to maneuver the baby, and can reduce the baby's pain perception. A top edge of the front panel can be tucked around the back of the baby's head or positioned around the head, similar to a hood, to provide support for the baby's head and neck and to ensure that the baby's breathing is unobstructed. As shown in FIGS. 8C and 8D, an opposed second front panel 140 can be drawn across the baby's back from the opposite side and can overlap the first front panel 130 such that a neckline is formed to allow the baby to breathe comfortably. The second front panel 140 can be fastened to the garment 110 to secure the baby in hands-free, skin-to-skin contact with the wearer. As shown in FIG. 8D, a belt 600 can be secured around the garment 110 to provide additional support for the baby, e.g., seated support.

One skilled in the art will appreciate further features and advantages of the invention based on the above-described embodiments. Accordingly, the invention is not to be limited by what has been particularly shown and described, except as indicated by the appended claims. All publications and references cited herein are expressly incorporated herein by reference in their entirety.

What is claimed is:

1. A garment for carrying an infant in a kangaroo care position, comprising:

A back panel having right and left lateral sides and a neck line;

a first front panel having an interior surface attached to the right side of the back panel, and a top edge that slopes arcuately downwardly from the neckline to a front panel free end;

A first arm opening located between the first front panel and the back panel;

a second front panel attached to the left side of the back panel having a top edge that slopes arcuately downwardly from the neckline to a second front panel free end;

a second arm opening located between the second front panel and the back panel;

a first pair of fasteners for adjustably coupling the first front panel to the second front panel at a location adjacent to the left side of the back panel in a cross panel configuration;

a second pair of fasteners for adjustably coupling the second front panel to the first front panel at a location adjacent to the right side of the back panel in a cross panel design; and a pocket formed on said interior surface of the first front panel, the pocket being configured to prevent a baby positioned within the garment from slipping out of the garment, and the pocket having a bottom and having a slit extending through a material forming the pocket adjacent and parallel to the bottom of the pocket for providing access to a baby within the pocket;

said first front panel and said second front panel when coupled in said cross panel design defining a front neck line that allows adequate space for air and for a baby's comfort and breathing, and carrying in a kangaroo position.

2. The garment of claim 1, wherein the first and second pairs of fasteners each comprise an exterior surface fastener formed on an exterior surface of the first front panel, and an interior fastener formed on an interior surface of the second front panel and configured to mate with the exterior fastener on the exterior surface of the first front panel.

3. The garment of claim 1, wherein the first and second pairs of fasteners are configured to be removably mated when the second front panel is positioned to overlay the first front panel to thereby securely hold the baby against a wearer's chest.

4. The garment of claim 1, wherein the pocket extends between right and left sides of the interior surface of the first front panel.

5. The garment of claim 1, further comprising a belt configured to be positioned around the garment.

6. The garment of claim 5, wherein the belt includes a fastening element on at least one terminal end thereof and configured to allow the terminal ends of the belt to adjustably mate to one another.

7. The garment of claim 5, wherein the belt comprises:

an elongate central support portion configured to be worn adjacent to the front panels and configured to provide support to a baby within the garment;

a first strap portion extending from one end of the central support portion, the first strap portion having a vertical slit therethrough; and a second strap portion having an interior surface and an exterior surface and extending from an opposed second end of the central support portion, the second strap portion having a fastener on a first exterior surface thereof and the second strap portion being configured to be threaded through the vertical slit and folded over on itself such that a size of the belt can be adjusted.

8. The garment of claim 5, wherein the belt comprises:

an elongate central support portion configured to be worn adjacent to the front panels and configured to provide support to a baby within the garment;

a first strap portion extending from one end of the central support portion, the first strap portion having a ring coupled to a terminal end thereof; and a second strap portion configured to be threaded through the ring on the first strap portion and to be folded over onto itself such that a size of the belt can be adjusted.

9. The garment of claim 1, wherein long sleeves extend from the first and second arm openings.

10. The garment of claim 1, wherein at least one of the first and second front panels are reinforced to support a weight of the baby.

11. The garment of claim 1, wherein at least one of the first and second pairs of fasteners comprise hook and loop fasteners.

12. The garment of claim 1 made from a material which is soft, breathable, moisture wicking, anti-bacterial and elastic.

13. A garment for carrying an infant in a kangaroo care position, comprising:

a back panel having a neck line and right and left sides;

a first front panel having right and left sides, the right side being attached to the right side of the back panel;

a second front panel having right and left sides, the left side being attached to the left side of the back panel;

each of said first and second panels having a top edge that slopes arcuately downwardly from the neck line to a panel free end;

said panels when attached creating a cross panel design to define said neck line a first arm opening located between the first front panel and the back panel;

a second arm opening located between the second front panel and the hack panel; and a pocket formed on an interior surface of one of the first and second front panels, the pocket having a pocket bottom and having a slit extending through a material forming the pocket adjacent and parallel to the pocket bottom for providing access to a baby within the pocket;

said back panel, and first and second panels and said pocket all being elastic material wherein the left side of the first front panel is configured to mate to the left side of the second front panel, and the right side of the second front panel is configured to mate to the right side of the first front panel such that the first and second front panels overlap, and wherein, when the first and second front panels are mated and overlapping, the first and second front panels define a front opening therebetween shaped to allow adequate space for air and a baby's comfort and breathing, and carrying in a kangaroo position.

14. The garment of claim 13, further comprising a belt configured to be positioned around the garment.

15. The garment of claim 13, wherein at least one of the first and second front panels is reinforced such that the at least one of the first and second front panels can be tucked around a head of a baby secured within the garment to provide support to the baby's head.

16. The garment of claim 13 made from a material which is also soft, breathable, moisture wicking, anti-bacterial.

17. A garment for carrying an infant in a kangaroo care position, comprising;

a back panel having right and left sides and a neck line;

first and second from panels each having right and left sides, the right side of the first front panel being attached to the right side of the back panel, and the left side of the second front panel being attached to the left side of the back panel, and the left side of the first front panel being matable to the left side of the second front panel, and the right side of the second front panel being matable to the right side of the first front panel such that the first and second front panels overlap creating a cross panel design when mated to define a sloped front neck opening that allows adequate space for air and a baby's comfort and breathing, and carrying in a kangaroo position;

a first arm opening located between the first front panel and the back panel;

a second arm opening located between the second front panel and the back panel; and a pocket having a bottom formed on the interior surface of one of the first and second front panels and being configured to prevent a baby positioned within the garment from slipping out of the garment, the pocket having a slit extending through a material forming the pocket adjacent to and parallel to the pocket bottom for providing access to a baby within the pocket;

said back panel, and first and second front panels all being elastic material.

18. The garment of claim 17, further comprising a belt configured to be positioned around the garment.

19. The garment of claim 17 made from a material which is also soft, breathable, moisture wicking, anti-bacterial.

* * * * *